US005671684A

United States Patent [19]

Lucas

[11] Patent Number: 5,671,684

[45] **Date of Patent: *Sep. 30, 1997**

[54] RAILWAY CAR OUTLET GATE ASSEMBLY WITH AUTOMATIC LOCK

[75] Inventor: Anthony L. Lucas, McPherson, Kans.

[73] Assignee: Keystone Industries, Inc., Camp Hill, Pa.

[ * ] Notice: The term of this patent shall not extend beyond the expiration date of Pat. No. 5,584,251.

[21] Appl. No.: 705,322

[22] Filed: Aug. 29, 1996

Related U.S. Application Data

[63] Continuation of Ser. No. 499,930, Jul. 10, 1995, Pat. No. 5,584,251.

[51] Int. Cl.[6] ..... B61D 7/24

[52] U.S. Cl. ..... 105/305; 105/282.3; 105/310.1; 105/310

[58] Field of Search ..... 105/282.1, 282.3, 105/286, 287, 288, 289, 305, 308.1, 308.2, 310.1, 311.1, 311.2, 310

[56] References Cited

U.S. PATENT DOCUMENTS

| | | | |
|---|---|---|---|
| 1,499,735 | 7/1924 | Hynes . | |
| 1,515,834 | 11/1924 | Campbell . | |
| 1,627,801 | 5/1927 | Mitchell . | |
| 2,142,236 | 1/1939 | Campbell | 105/282 |
| 2,340,519 | 2/1944 | Dorey . | |
| 2,479,292 | 8/1949 | Batho | 105/250 |
| 2,644,408 | 7/1953 | Dorey | 105/282 |
| 2,749,770 | 6/1956 | Dorey | 74/548 |
| 2,893,327 | 7/1959 | Lunde | 105/240 |
| 3,082,703 | 3/1963 | Dorey | 105/282 |
| 3,110,270 | 11/1963 | Ingram | 105/253 |
| 3,241,730 | 3/1966 | Dorey | 222/505 |
| 3,248,026 | 4/1966 | Kemp | 222/54.5 |
| 3,316,859 | 5/1967 | Floehr | 105/253 |
| 3,344,748 | 10/1967 | Dorey . | |
| 3,387,570 | 6/1968 | Pulcrano et al. | 105/282 |
| 3,397,654 | 8/1968 | Snyder | 105/305 |
| 3,415,204 | 12/1968 | Pase . | |
| 3,552,323 | 1/1971 | Dorey . | |

(List continued on next page.)

OTHER PUBLICATIONS

Association of American Railroads,"Specification for New Gravity Outlet Gates on Covered Hopper Cars," Standard S-233-92 (7 pages, Sep. 1, 1992.

W.H. Miner Division, Advertisement "AutoLOK Discharge Gate" (1 page, Sep. 18, 1992).

Trinity Industries, Inc. Advertisement "Geaps-Snap-Lock Gravity Outlet Gates" (1 page,RSB-Geaps 0995-2).

IEC-Holden, Inc. Advertisement "The New Direction for Hopper Car Gravity Discharge Gates" (6 pages).

Procor Advertisement "Toggle-Lock Outlet Gates" (4 pages, 1996).

American Railcar Industries Advertisement "Gravity Outlet" (4 pages, Sep. 1996).

Miner Enterprises, Inc. Advertisement "AutoLOK II Discharge Gate" (2 pages, Sep. 1996).

Keystone Drawing "Portlok IV" No. SE-15485 The drawing depicts a prior gate sold commercially by Applicant's Assignee of the type described at p. 2-p. 3, ln 19 of the pending Application.

Attached Exhibit A—additional documents from pending patent litigation.

*Primary Examiner*—S. Joseph Morano

*Attorney, Agent, or Firm*—Thomas Hooker, P.C.

[57] ABSTRACT

An outlet gate assembly for a hopper type railway car includes a frame adapted to be mounted on an outlet opening in the rail car and a plate in the frame. An integrated rack and pinion drive moves the plate between open and closed positions on the frame. The drive includes a drive shaft, slip sockets mounted on the ends of the drive shaft and connected to the drive shaft through lost motion connections, pinion gears mounted directly to the drive shaft and rotatable with the drive shaft, racks mounted on the plate engaging the pinion gears so that rotation of the drive shaft moves the plate between the open and closed positions and a latch actuated by movement of either socket for latching the plate in the fully closed position and unlatching the plate prior to rotation of the drive shaft to open the plate.

7 Claims, 11 Drawing Sheets

U.S. PATENT DOCUMENTS

| | | | |
|---|---|---|---|
| 3,630,154 | 12/1971 | Mundinger . | |
| 3,631,813 | 1/1972 | Dorey . | |
| 3,682,105 | 8/1972 | Marulic . | |
| 3,683,820 | 8/1972 | Floehr . | |
| 3,707,126 | 12/1972 | Nester . | |
| 3,709,152 | 1/1973 | Gutridge | 105/253 |
| 3,710,729 | 1/1973 | Schuller | 105/240 |
| 3,779,172 | 12/1973 | Schipper et al. . | |
| 3,837,294 | 9/1974 | Fossett | 105/253 |
| 3,877,392 | 4/1975 | Akester et al. . | |
| 3,893,398 | 7/1975 | Fischer . | |
| 3,933,100 | 1/1976 | Dugge . | |
| 3,956,996 | 5/1976 | Fischer . | |
| 3,958,514 | 5/1976 | Akester et al. . | |
| 4,006,692 | 2/1977 | Chierici . | |
| 4,094,254 | 6/1978 | Koranda . | |
| 4,099,468 | 7/1978 | Adler | 105/310 |
| 4,214,536 | 7/1980 | Waddell et al. . | |
| 4,224,879 | 9/1980 | Van Auken . | |
| 4,253,400 | 3/1981 | Fischer et al. . | |
| 4,256,042 | 3/1981 | Fischer . | |
| 4,262,603 | 4/1981 | Morse | 105/310 |
| 4,301,741 | 11/1981 | Chierici . | |
| 4,342,267 | 8/1982 | Blout . | |
| 4,450,773 | 5/1984 | Fritz et al. . | |
| 4,534,298 | 8/1985 | Scott . | |
| 4,664,038 | 5/1987 | Davis | 105/308.1 |
| 4,766,820 | 8/1988 | Ritter et al. | 105/240 |
| 4,843,974 | 7/1989 | Ritter et al. | 105/240 |
| 5,046,432 | 9/1991 | Bowler | 105/282.1 |
| 5,272,987 | 12/1993 | Lucas | 105/308.1 |
| 5,353,713 | 10/1994 | Dohr et al. | 105/310 |
| 5,448,955 | 9/1995 | Dugge et al. | 105/305 |
| 5,507,235 | 4/1996 | Dugge et al. | 105/282.3 |

RAILWAY CAR OUTLET GATE ASSEMBLY WITH AUTOMATIC LOCK

This is a continuation of application Ser. No. 08/499,930 filed on Jul. 10, 1995, now U.S. Pat. No. 5,584,250.

FIELD OF THE INVENTION

The invention relates to outlet gate assemblies for railway hopper cars of the type having a latch holding the gate closed and an integrated plate drive for automatically unlatching and then opening the gate.

BACKGROUND OF THE INVENTION

Hopper-type railway cars are used to transport lading which is discharged from the hopper car through outlet gate assemblies mounted on discharge openings at the bottom of the car. Each gate assembly includes a door plate and a drive for moving the plate between opened and closed positions. When closed, the plate prevents discharge of lading. When the plate is opened, the lading is free to discharge through the assembly.

Conventional gate assemblies include rack and pinion drives used to shift the plate between the open and closed positions. Typically, a pair of racks are secured to the lower surface of the plate and engage pinion gears mounted on a transverse drive shaft. The opposed ends of the drive shaft extend to opposite sides of the gate assembly and carry capstans. The assemblies are opened or closed by rotating a capstan in a appropriate direction to rotate the pinion gears on the drive shaft and the plate in an appropriate direction.

The conventional gate assembly includes a latch which engages the edge of the plate after it has been moved to the fully closed position by the drive. Rotation of a capstan to move the plate to the closed position does not automatically engage the latch. The plate must be closed and then the latch is manually moved to engage the plate and hold the plate fully closed. Typically, the yard worker closes the plate by rotating the capstan. The worker must then manually engage the latch. The latch must also be manually disengaged prior to moving the plate from the closed to the opened position.

In Jul., 1992, the Association of American Railroads revised the Standard S-233-92 governing latching systems for outlet gate assemblies for hopper-type railway cars. The revised standard requires that the latch/unlatch functions be integrated into the discharge gate operating mechanism. Rotation of a capstan in a direction to open the plate must first unlatch the plate and then move the plate from the closed to the open position.

A prior outlet gate assembly, meeting the revised AAR standard S-233-92 provides lost motion connections between the operating shaft and the pinion gears which are meshed with racks on the bottom surface of the plate. The drive shaft carries a cam which is engageable with the plate latch when the plate is in the closed position. A capstan is directly mounted on each end of the drive shaft and rotates with the drive shaft. Initial rotation of the drive shaft collapses lost motion connections between the shaft and the pinion gears without rotating the gears or moving the plate from the closed position while moving the cam into engagement with the latch to unlatch the plate. After the plate has been unlatched, the lost motion connections are collapsed and continued rotation of the drive shaft rotates the pinion gears to move the unlatched plate to the open position. The lost motion connections used in this gate assembly are located on the drive shaft at relatively inaccessible locations under the assembly frame. In this type of a gate assembly, the pinion gears are loose on the drive shaft so that it is difficult for workers to mount the drive shaft on the frame with the pinion gears properly meshed and timed with the racks on the plate for proper integrated unlatching during opening of the gate. Further, the pinion gears with lost motion connections are located under the frame between frame extensions. It is difficult for a worker to inspect the lost motion connections to make sure that they are free of track debris and operate properly. Debris captured within the lost motion connections could prevent proper integrated operation of the gate assembly.

SUMMARY OF THE INVENTION

The present invention is an improved outlet gate assembly with a latch for holding the plate in the fully closed position and an integrated drive for latching and unlatching the plate and moving the plate between open and closed positions. Initial rotation of a capstan moves a latch to free the plate for movement without rotating the drive shaft. Continued rotation of the capstan collapses a lost drive motion connection with the drive shaft and rotates the drive shaft to move the plate to the open position through a rack and pinion connection. Rotating a capstan to close the plate moves the plate from the open position to the fully closed position and positively seats a latch to hold the plate in the closed position. Two embodiments are disclosed.

Each embodiment outlet gate assembly includes a rectangular frame defining a discharge opening, a plate movable on the frame between open and closed positions, a drive shaft extending across the front of the plate with pinion gears mounted on the drive shaft and engageable with racks on the bottom of the plate to shift the plate between opened and closed positions. The pinion gears are directly mounted on and rotate with the drive shaft.

The ends of the drive shaft extend to either side of the frame. Slip sockets are mounted on the ends of the drive shaft through lost motion connections permitting limited rotation of each slip socket without rotation of the drive shaft. Each socket includes a capstan and a sleeve joined to an end of the drive shaft through a lost motion connection. A latch shaft extends across the frame above the drive shaft with the ends of the latch shaft located above the slip sockets. Cam follower arms on the ends of the latch shaft extend down toward the drive shaft and are selectively engaged by lift cams mounted on the slip sockets. A plate latch is also mounted on the latch shaft for engagement with a stop member movable with the plate to lock the plate in the closed position.

The plate is moved from the closed and latched position to the open position by continuously rotating one of the two capstans in an opening direction. Initial rotation of the capstan rotates the driven slip socket on one end of the drive shaft to collapse the lost motion connection without rotating the drive shaft. During this initial rotation of the slip socket, the cam latch lift cam on the rotated sleeve engages the adjacent cam follower arm and lifts the arm to rotate the latch shaft and thereby move the latch on the shaft out of engagement with the stop member. Lifting of the latch frees the plate for movement toward the open position.

Upon unlatching movement of the latch, further opening rotation of the driven capstan fully collapses the lost motion connection between the socket and the drive shaft and rotates the drive shaft and pinion gears on the shaft to engage the racks and move the plate from the closed position to the open position. The latch shaft is located above the plate and carries a finger which rests on the plate to hold the latch and the two follower arms out of engagement with moving parts as the plate is opened.

The plate may be opened by rotating either of the two slip sockets in an opening direction. Initial rotation of either socket first unlatches the plate and then moves the plate to the open position.

In a first embodiment outlet gate assembly, the latch is on the latch shaft above the center of the plate and engages an edge of a stop plate secured to the bottom of the front edge of the plate.

In a second embodiment outlet gate assembly, the latch is on the latch shaft at one end of the latch shaft and engages a stop finger on the drive shaft. Engagement between the latch and stop finger prevents rotation of the drive shaft and, through the pinion gear-rack drive connection, prevents opening of the plate.

Both disclosed embodiments comply with the Association of American Railroads revised Standard S-233-92 and include an integrated gate drive where continuous rotation of one of the capstans first positively unlatches the plate and then moves the plate from the closed to the open position.

In the present invention, the lost motion connections between the slip sockets and the ends of the drive shaft are located outwardly to either side of the frame and are easily accessible by a worker. A worker can easily determine whether or not the lost motion connections are working properly by rotating a capstan on the end of a fixed drive shaft and visually determining the angle of free rotation. Further, the lift cams and follower arms through which the latch is rotated out of engagement with the stop member are likewise located to one side of the assembly and are readily accessible to a worker to determine if the lift mechanism is working properly. Operation of this mechanism wipes the cams past the follower arms to dislodge road dirt, dust, silt, from the mechanism to assure proper operation.

Gate assemblies per the invention are manufactured and assembled at the original manufacturer's shops. Frequently, these assemblies are shipped to a car builder and are disassembled to facilitate mounting on a hopper car. After the frame has been mounted on the hopper car, it is necessary to reassemble the plate, drive shaft, slip sockets and the lost motion connections between the slip sockets and the drive shaft. Reassembly of the integrated drive requires that the capstans be properly located on the ends of the drive shaft and that the pinion gears on the drive shaft properly engage the teeth on the racks to proper operation of the integrated drive.

Workmen in the car manufacturer's shop are not skilled at assembling and timing outlet gate assemblies. The location of the lost motion connections in the present invention on the ends of the drive shafts, where the connections are readily accessible to workers, reduces the difficulty in properly timing and assembling the parts of the outlet gate assembly. Additionally, location of the slip sockets and the cam and follower arm drives for rotating the latch on the sides of the gate assembly facilitates the reassembly and determination that the integrated drive functions properly.

Other objects and features of the invention will become apparent as the description proceeds, especially when taken in conjunction with the accompanying drawings illustrating the invention, of which there are 11 sheets and two embodiments.

DESCRIPTION OF THE PREFERRED EMBODIMENT

Figure 1:
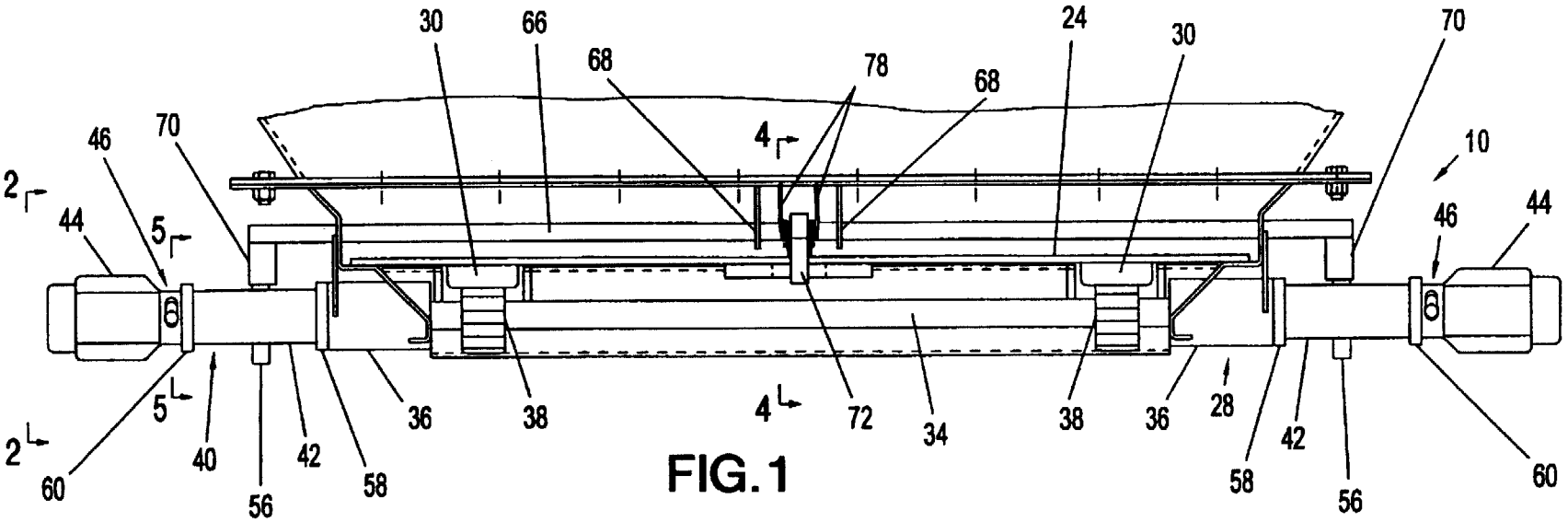
FIG. 1 is a front view of a first embodiment outlet gate assembly.

FIGS. 1 through 7 illustrate the first embodiment outlet gate assembly.

Outlet gate assembly 10 includes a rectangular frame 12 having a rear frame member 14, a pair of side frame members 16, and a front frame member 18 defining a rectangular discharge opening 20. Extensions 22 of side frame members 16 project beyond the rear frame member 14. Rectangular gate assembly 10 is bolted to a discharge opening in the bottom of a hopper-type railway car to control the discharge of lading from the car.

Figure 2:
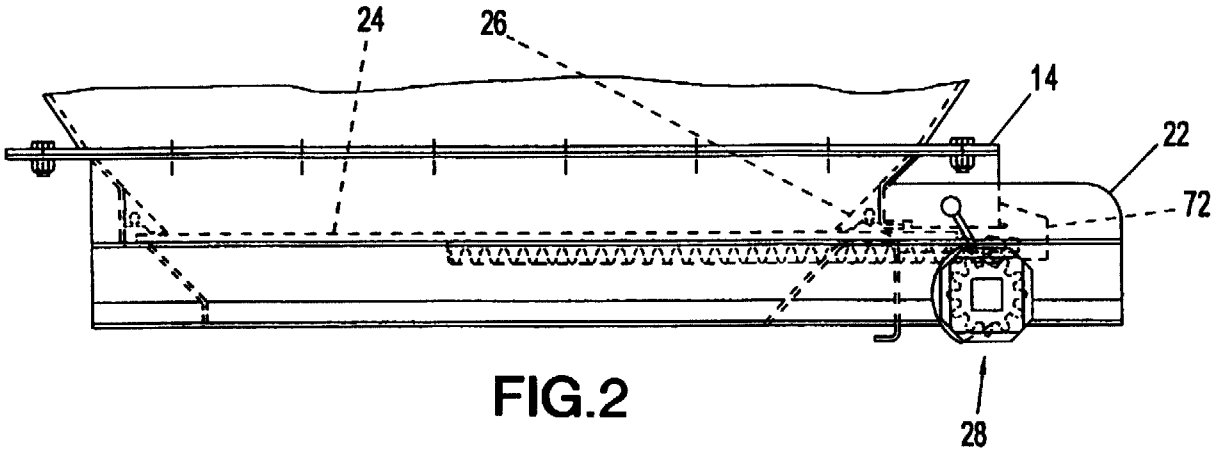
FIG. 2 is a side view of the assembly of FIG. 1 taken along line 2—2 of FIG. 1.
Figure 3:
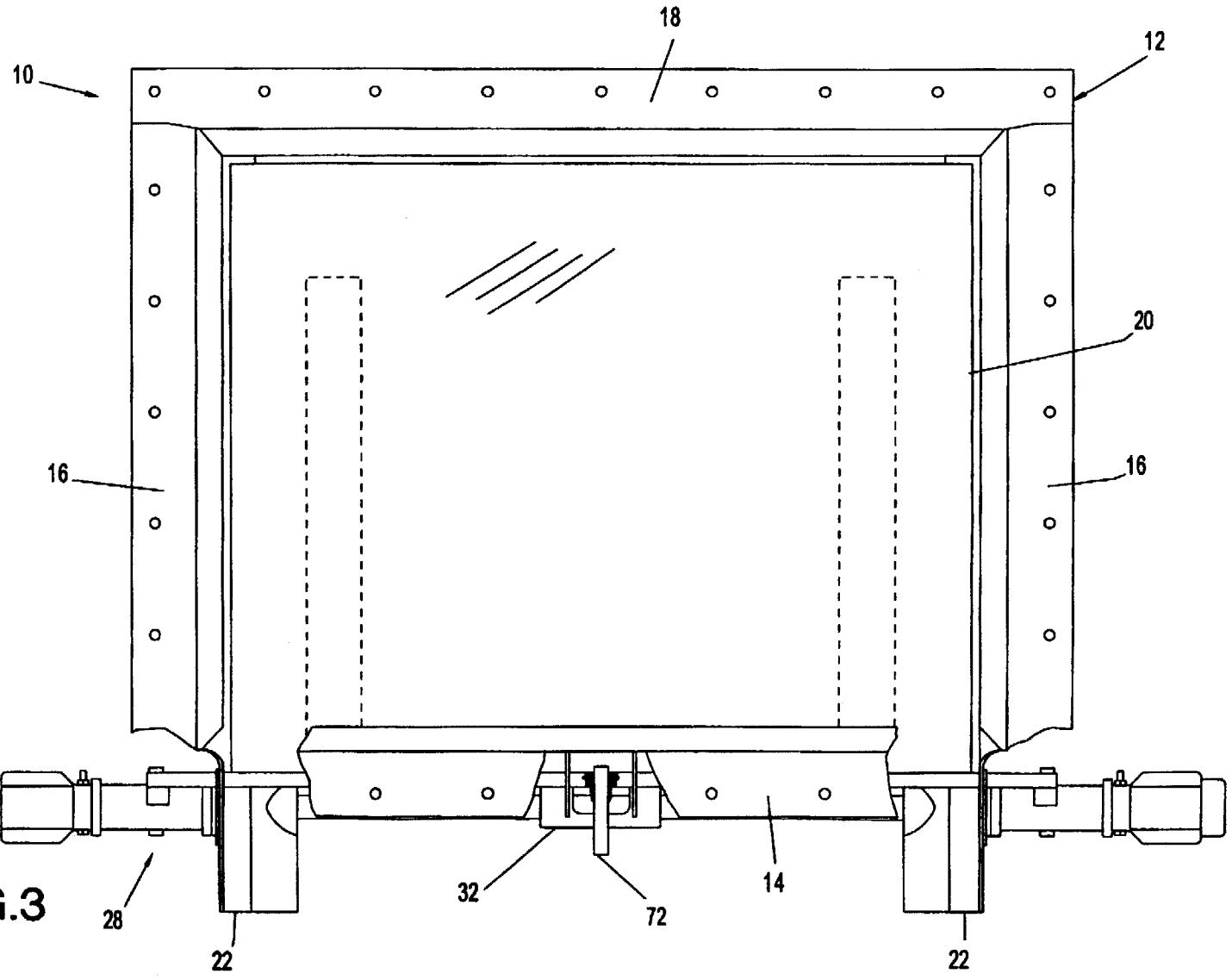
FIG. 3 is a top view of the assembly of FIG. 1.
Figure 4:
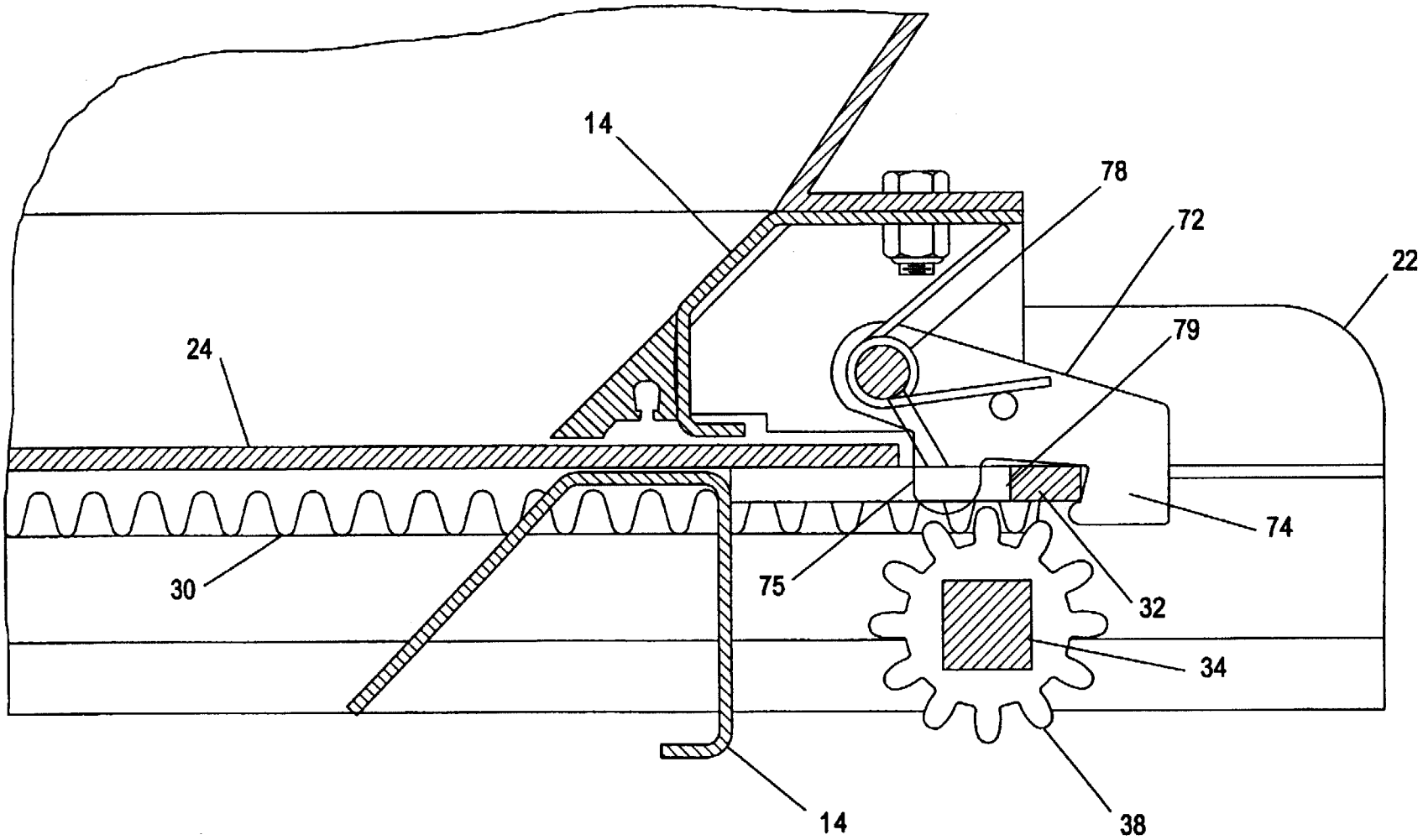
FIG. 4 is a sectional view taken along line 4—4 of FIG. 1.
Figure 5:
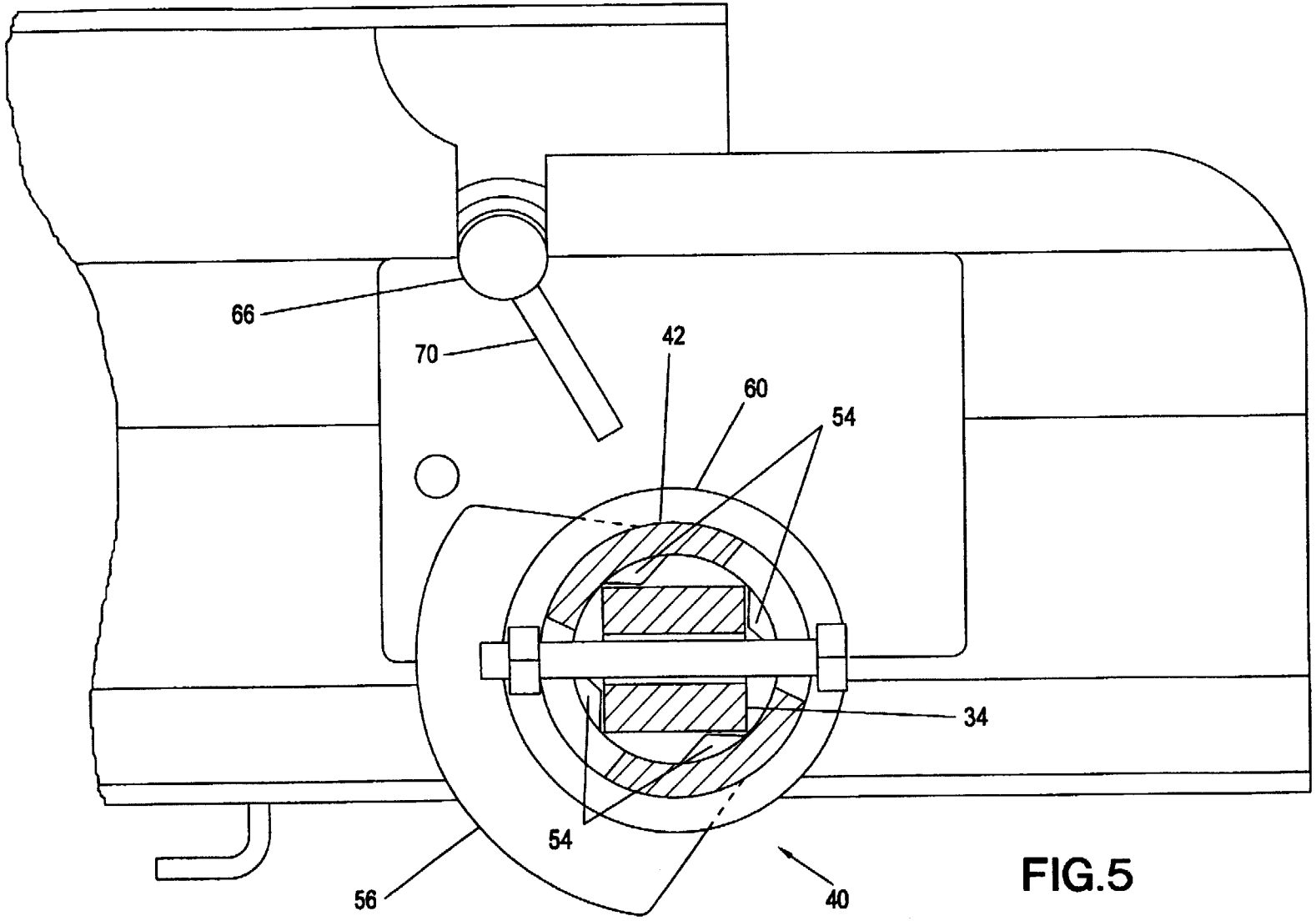
FIGS. 5, 6, and 7 are sectional views, partially broken away, taken generally along line 5—5 of FIG. 1 illustrating the operation of the assembly.
Figure 6:
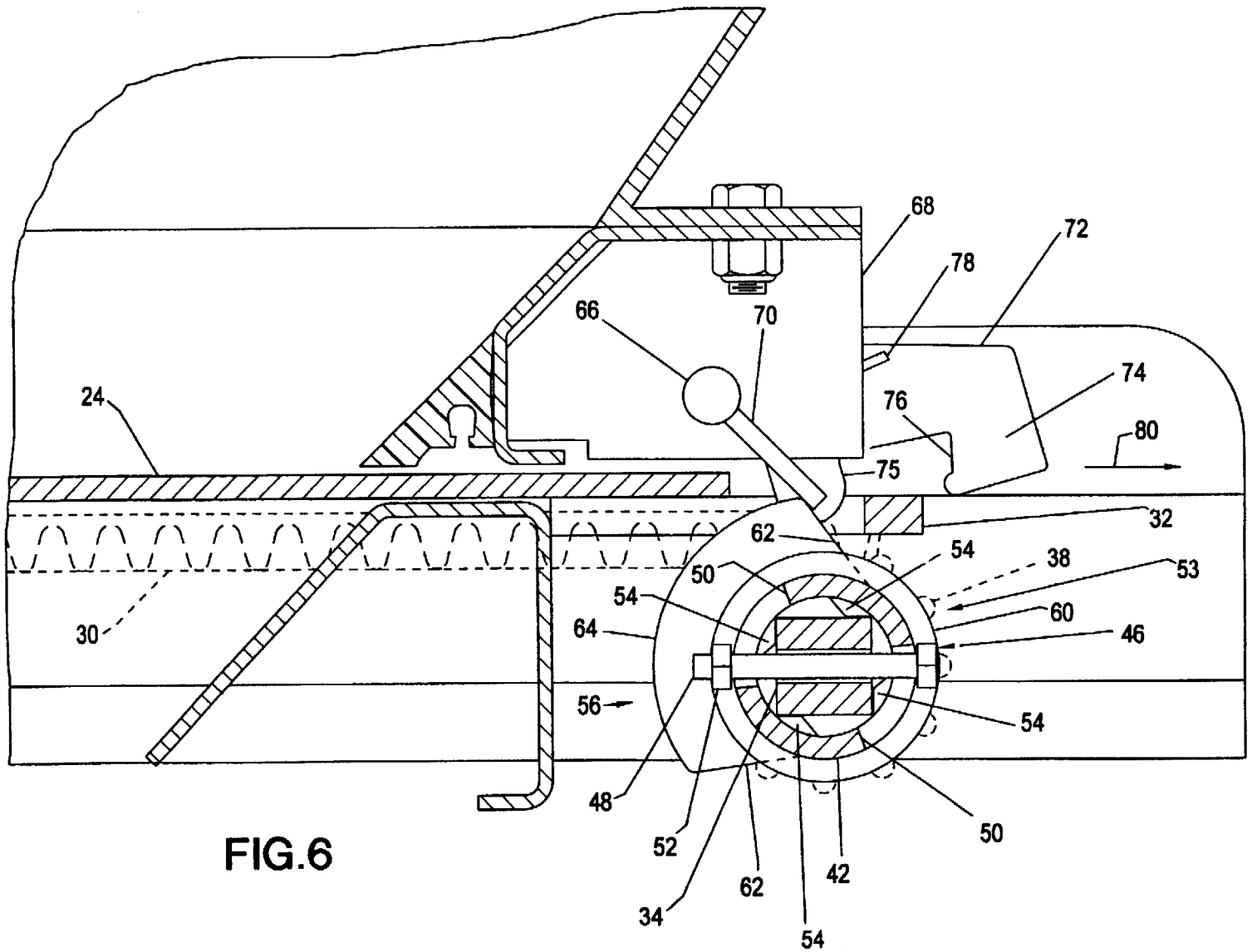
Figure 7:
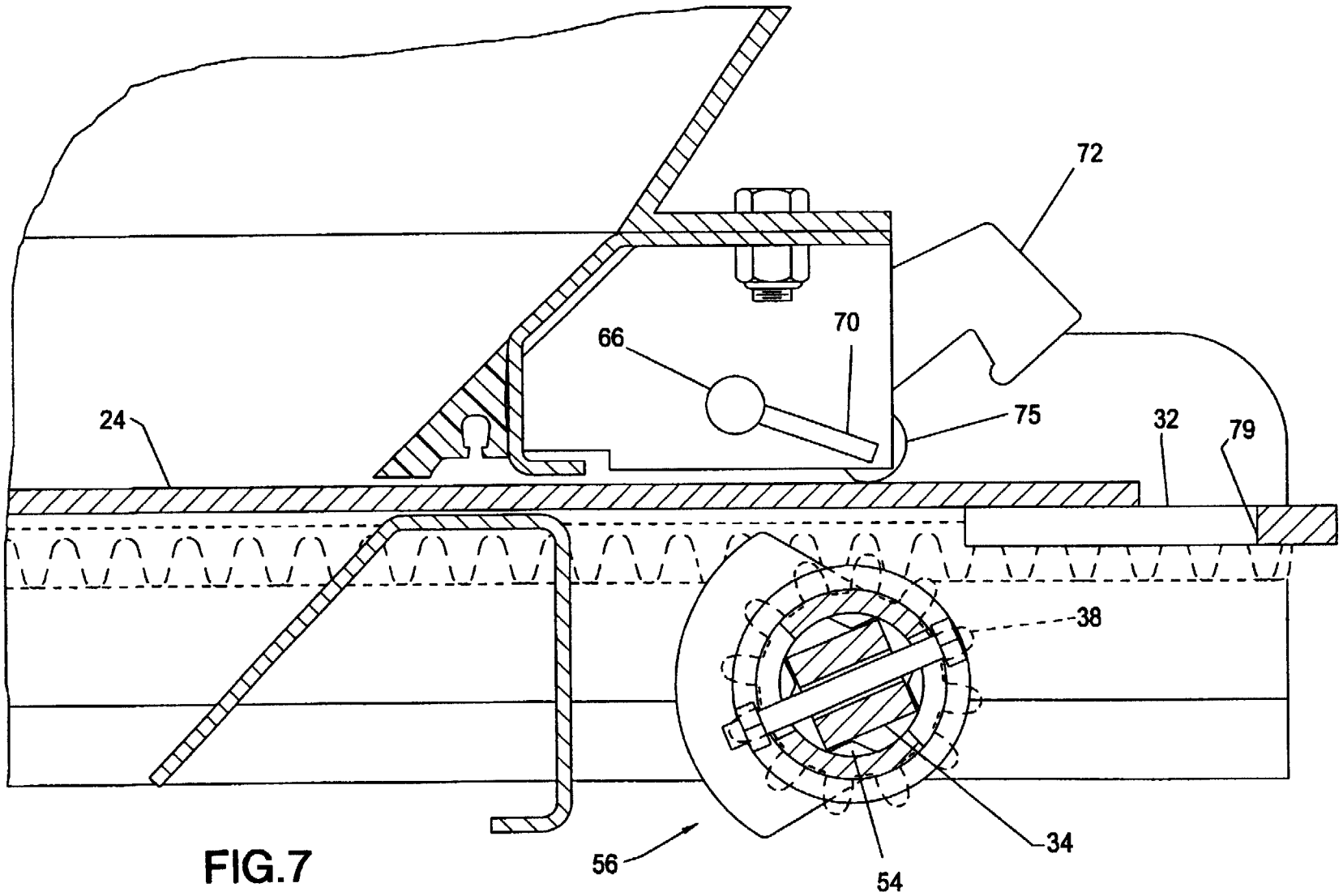
Figure 8:
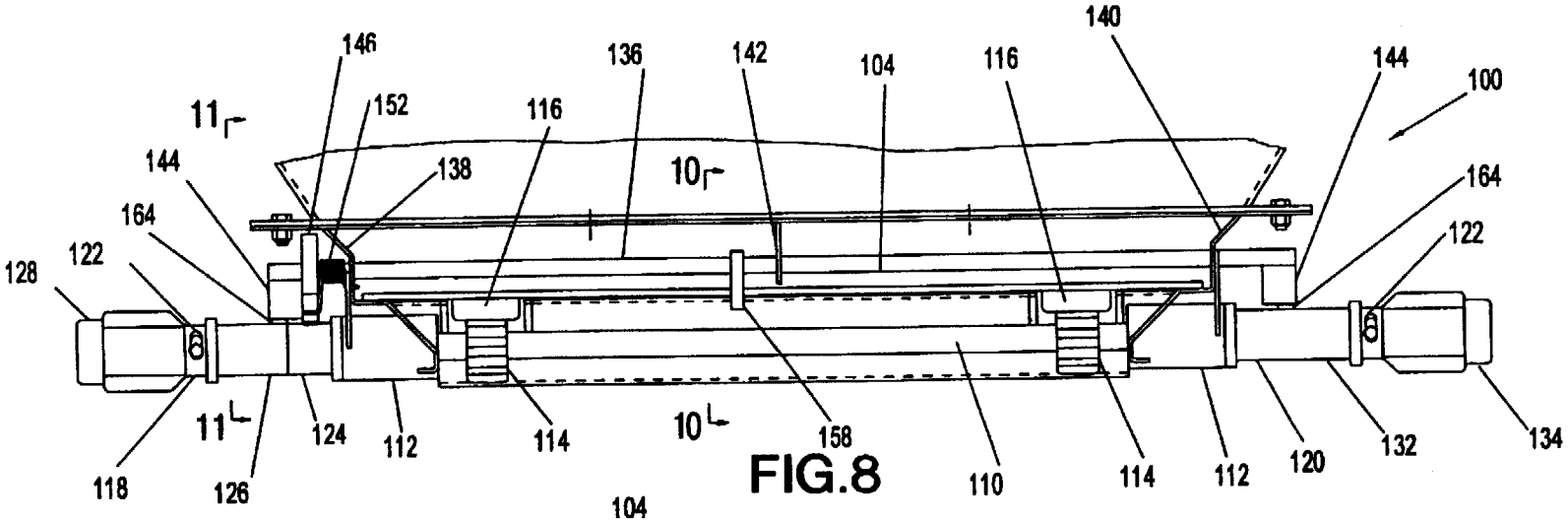
FIG. 8 is a front view of a second embodiment outlet gate assembly.

A rectangular plate 24 is mounted in frame 12 and is movable between a closed position in which the plate completely closes opening 20 and an open position in which the plate is free of the opening. The plate extends through slot 26 formed in the rear side member 14 as shown in FIG. 2. When the plate is closed, the front and side edges of the plate fit in grooves in the side and front frame members 16 and 18 to close opening 20. Conventional seals (not fully illustrated) are provided at slot 26 and at the grooves. As shown in FIGS. 3 and 4, a stop plate 32 is secured to the bottom of the rear edge of plate 24 midway between the side frame members 16 and extends outwardly a distance beyond the rear edge of the plate. When the plate 24 is fully closed as shown in FIG. 4, the inner edge of the plate 32 engages the rear frame member 14. See FIG. 4.

The plate 24 is moved from the closed position out through slot 26 to the open position by an integrated plate drive 28 mounted on side frame member extensions 22. The drive includes a pair of spaced parallel racks 30 mounted on the lower surface of plate 24, a square drive shaft 34 extending between and through side frame member extensions 22 and journalled in bearings 36 mounted on the extensions and a pair of pinion gears 38 on the drive shaft and meshed with the teeth of racks 30. The pinion gears 38 are directly or fixedly connected to the drive shaft 34 and rotate with the drive shaft. The ends of the drive shaft 34 extend outwardly or outboard of the frame side extensions 22. A pair of like slip sockets 40 are mounted on the ends of drive shaft 34 outwardly of extensions 22.

Each slip socket includes a sleeve 42 rotatably mounted on the end of the drive shaft and a capstan 44 on the outer end of the sleeve. The slip socket is held on an end of the drive shaft by a slot and bolt connection 46. This connection includes a bolt 48 having a shank which extends through a pair of partial circumferential slots 50 formed in opposite sides of sleeve 42 and a bore 53 extending through the end of the drive shaft 34 in the sleeve. The slots 50 are sufficiently long to allow slightly more than 45 degrees of relative rotation between the sleeve and the end of the drive shaft 34. Nut 52 is secured to the end of the bolt to hold the bolt in place. Connection 46 prevents axial shifting of the socket on the drive shaft while permitting relative rotation of the socket on the drive shaft.

The plate drive 28 includes a lost motion drive connection 53 between each slip socket and the end of the drive shaft on which the socket is mounted. Connection 53 includes four like stop projections 54 on the interior wall of sleeve 42 located at 90 degree intervals spaced around the sleeve. The drive projections 54 are each provided with a pair of flat contact surfaces. Rotation of the sleeve on the drive shaft in one direction moves the contact surfaces on one side of the projections against the drive shaft to rotate the drive shaft. Rotation of the sleeve on the drive shaft in the opposite direction moves the contact surfaces on the other side of the projections against with the drive shaft to rotate the drive shaft. The sleeve has 45 degrees of lost motion on the drive shaft, as indicated by the 45-degree spacing between adjacent projections.

A latch lift cam 56 is mounted on the outer surface of each sleeve 42 between collars 58 and 60 and includes sloped end surfaces 62 and a dwell surface 64 between the end surfaces.

Latch shaft 66 is located outside the front frame member 14 and extends across the width of frame 12 through holes formed in side frame member extensions 22 and in a pair of support plates 68 joined to front frame member 14. The ends of the latch shaft are located above lift cams 56 and are provided with follower arms 70 which extend generally downwardly from the latch shaft for engagement with cams 56.

A latch 72 as shown in FIG. 4 is secured to shaft 66 and extends generally forwardly from the shaft away from the front frame member 14. A downwardly projecting hook 74 is provided on the free end of the latch and defines a plate-receiving recess 76 facing the front frame member. Rounded lift finger or member 75 extends downwardly from the latch between the hook 74 and shaft 66. Springs 78 are wrapped around the latch shaft with ends engaging a cross pin in the latch and the front frame member to bias the shaft, latch and follower arms in a clockwise direction as shown in FIG. 4 so that the hook end of the latch 72 is biased downwardly and arms 70 are biased toward sleeves 42.

FIG. 4 illustrates the assembly 10 with plate 24 in the closed position and with the latch 72 held in a downward position by springs 78 and hook 74 engaging the outer edge of stop plate 32. The edge of the plate forms a stop member. Lift finger 75 extends into cut-out recess 79 in stop plate 32. The inner edge of the stop plate is flush against the cross frame member. The latch and cross member cooperate to prevent forward or rearward movement of plate 24 in frame 12.

The operation of the first embodiment outlet gate assembly 10 will now be described.

When plate 24 is fully closed as in FIG. 4, plate 32 is confined between the cross frame member 14 and hook 74 of latch 72. The springs 76 hold the latch in the closed position to prevent accidental opening of the plate due to vibrations of the railway car during transit, coupling shocks, train action loadings and other inertial forces experienced by assembly 10 during loading and transport of the hopper railcar. In this position, the follower arms 70 extend down toward the sleeves 42 and are in the path of opening movement of cams 56. Springs 78 hold the follower arms down in a position of FIG. 5 during the time the plate is locked closed.

The gate assembly may be opened by a worker from either side of the rail car by rotating one of the capstans 44 in an opening direction. The worker may rotate the capstan by using a power drive engaging the capstan or a pry bar having an end inserted into the capstan.

The opening of closed and latched gate assembly 10 by rotating the capstan 44 on the left hand slip socket 40 as shown in FIG. 1 in the opening direction will be described, it being understood that the gate assembly may also be opened in exactly the same manner by rotating the capstan 44 on the right hand socket as shown in FIG. 1 in the opening direction.

Initial clockwise rotation of right capstan 44 rotates the associated sleeve in a clockwise direction, collapses the lost motion drive connection 53 between the sleeve and drive shaft 34 and rotates the lift cam 56 on the sleeve into engagement with the downwardly extending adjacent follower arm 70. The end surface 62 on the lift cam engages the follower arm so that rotation of the socket during collapse of the lost motion connection lifts the lower end of the arm 70 upwardly to rotate the latch shaft 66 in a counterclockwise direction against springs 78. When the socket has been rotated sufficiently to move the follower arm onto the dwell surface 64 of cam 56, latch 72 has been lifted above the stop plate 32 to unlatch plate 24 for outward movement toward the open position.

Rotation of the slip socket after plate 24 is unlatched fully collapses the lost motion connection 53 and moves the drive projections on the sleeve into engagement with the drive shaft to rotate the drive shaft 34. Rotation of the drive shaft rotates the pinion gears 38 meshed with racks 30 to move the plate outwardly in the direction of arrow 80 shown in FIG. 7 toward the open position. Upward rotation of the latch lifts finger 75 from recess 79. The front edge of plate 24 engages the finger and further rotates the latch up so that the end of the latch 72 rides along the top of the plate 24 during opening and arms 70 are held above the cams 56 on both sockets 40. Springs 78 hold the finger 75 against the top of plate 24.

The driven capstan is rotated in a clockwise opening direction and drives the drive shaft in a clockwise direction to move the gate in the direction of arrow 80 until the gate is fully opened.

The open gate assembly is fully closed and latched by rotating either of the capstans in a closing direction. Initial closing rotation of the driven capstan will rotate the sleeve to collapse the lost motion connection between the sleeve and the drive shaft and move the drive projections into engagement with the drive shaft for closing rotation of the drive shaft. Continued closing rotation of the capstan will then rotate the drive shaft and pinion gears to move plate 24 inwardly. During this time, the spring 78 holds latch 72 down against the surface plate 24 so that arms 70 are held above rotating cams 56. As the plate is moved to the fully closed position, the lift finger 75 falls into recess 79 to latch plate 24 closed and both arms 70 are lowered below the height of the dwell surfaces 64 of lift cams 56. The lift cam 56 of the driven socket is located circumferentially away from the lowered adjacent arm 70.

The lift cam 56 of the non-driven slip socket is mounted on the adjacent end of the drive shaft through a lost motion connection 55 and may rotate on the shaft. When finger 75 falls into the recess 79, the non-driven capstan is circumferentially located oh the drive shaft with the lift cam either out of the path of downward movement of the adjacent arm 70 or positioned so that arm 70, when it falls under the influence of springs 78, engages an end surface 62 of the cam. The springs 78 are sufficiently strong to push the arm 70 down and rotate the non-driven socket out of the path of movement of the arm. In this way, closing rotation of the driven socket moves the plate to the fully closed position with the plate 24 latched closed and both follower arms in position to unlatch the plate upon opening rotation of either capstan.

FIGS. 8 through 13 illustrate a second embodiment outlet gate assembly 100 Assembly 100 includes a rectangular frame with front, side, and rear frame members like frame 12 of assembly 10. Plate 104 is mounted in frame and extends through a slot 106, like slot 26, formed in the rear member of frame. An integrated plate drive 108 moves plate 104 between the closed and opened positions.

Figure 9:
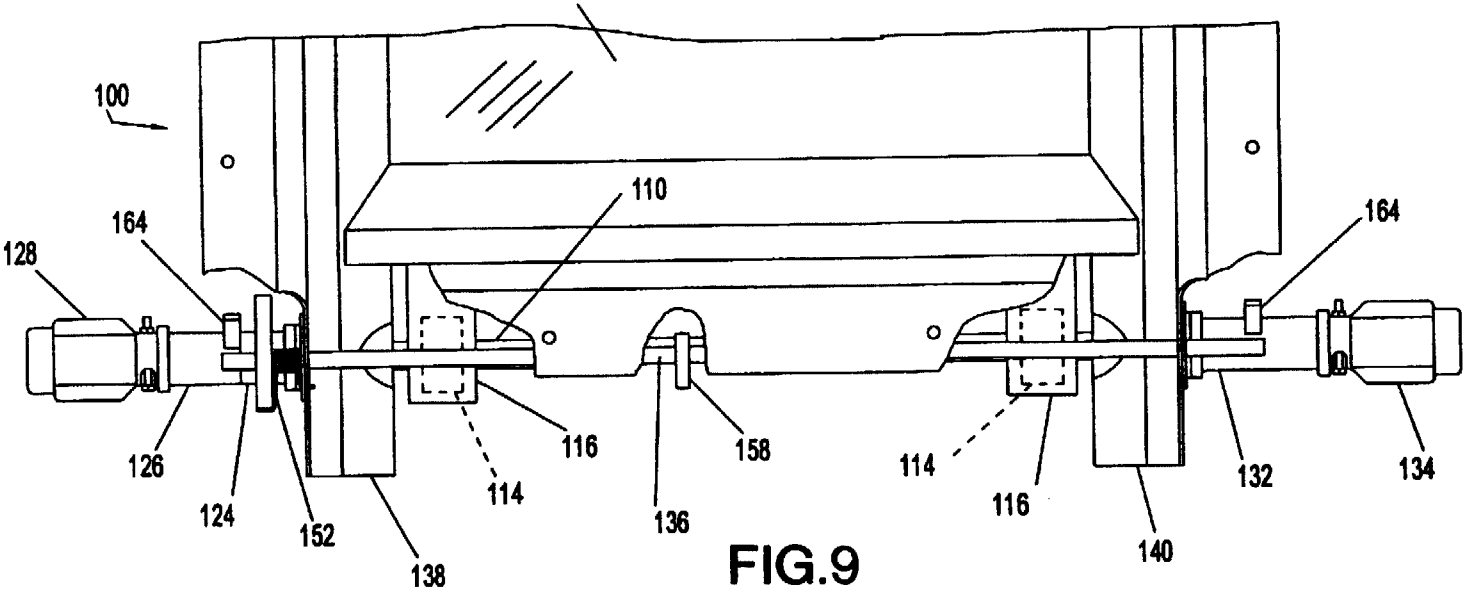
FIG. 9 is a side view of the assembly of FIG. 8.

Drive 108 includes a square drive shaft 110 which is journalled in a pair of bearings 112 mounted on the rear extensions of frame member with the ends of the drive shaft extending outwardly of the extensions. A pair of pinion gears 114 are directly mounted on the drive shaft 110 and rotate with the drive shaft. Gears 114 mesh with racks 116 secured to the lower surface of plate 104 such that rotation of the drive shaft shifts the plate between the open and closed positions. A first slip socket 118 is mounted on the end of the drive shaft on the left of gate assembly 100 as shown in FIG. 9. A second slip socket 120 is mounted on the right end of the drive shaft. Each slip socket is held on the drive shaft by a slot and bolt connection 122, like connection 46 of the first embodiment gate assembly 10. The connections 122 hold the sockets on the drive shaft and permit relative rotation between each socket and the drive shaft. Latch lift cam 164 is mounted on sleeve 126. Collar 124 is located between the first slip socket 118 and the adjacent bearing 112 and is directly secured to drive shaft 110 to rotate with the drive shaft.

The first slip socket 118 includes a sleeve 126 rotatably mounted on the drive shaft and a capstan 128 joined to the sleeve. Four 90 degree spaced drive projections 130, like projections 54, extend inwardly from sleeve 126 to engage the sides of the square drive shaft 110 and rotate the shaft either clockwise or counterclockwise, depending upon the direction of rotation of capstan 128. The projections form a 45 degree lost motion drive connection between the sleeve and the shaft.

Slip socket 120 includes a sleeve 132 rotatably mounted on an end of the drive shaft 110 and a capstan 134 located outwardly of the sleeve. Drive projections (not illustrated) like projections 130 are provided on the inner surface of sleeve 132 to engage the sides of the drive shaft and rotate the drive shaft to open or close the gate, depending upon the direction of rotation of capstan 134. These projections form a 45 degree lost motion drive connection between the sleeve and the shaft. A latch lift cam 164 is mounted on sleeve 132.

Figure 10:
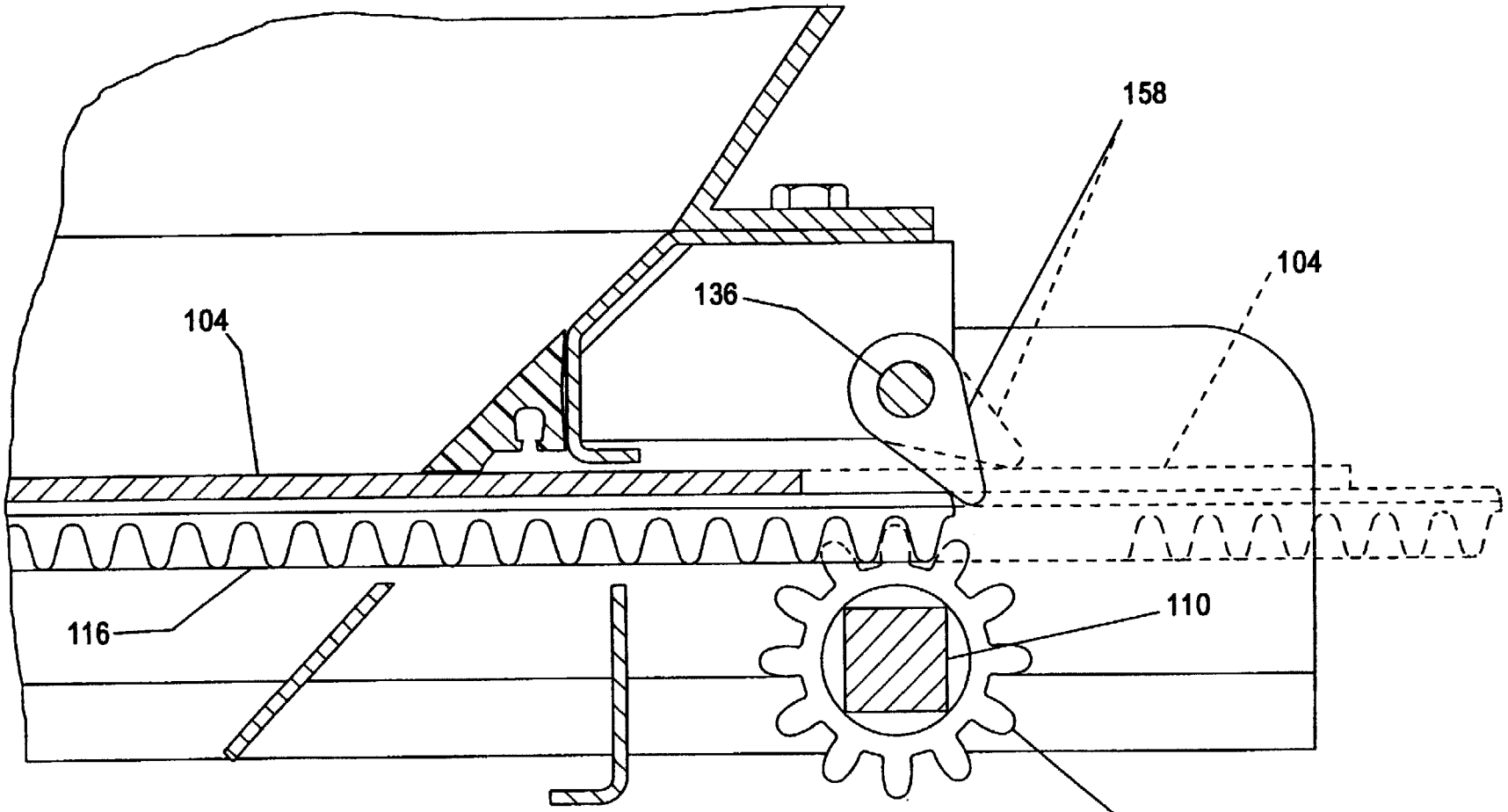
FIG. 10 is a sectional view taken along line 10—10 of FIG. 8.
Figure 11:
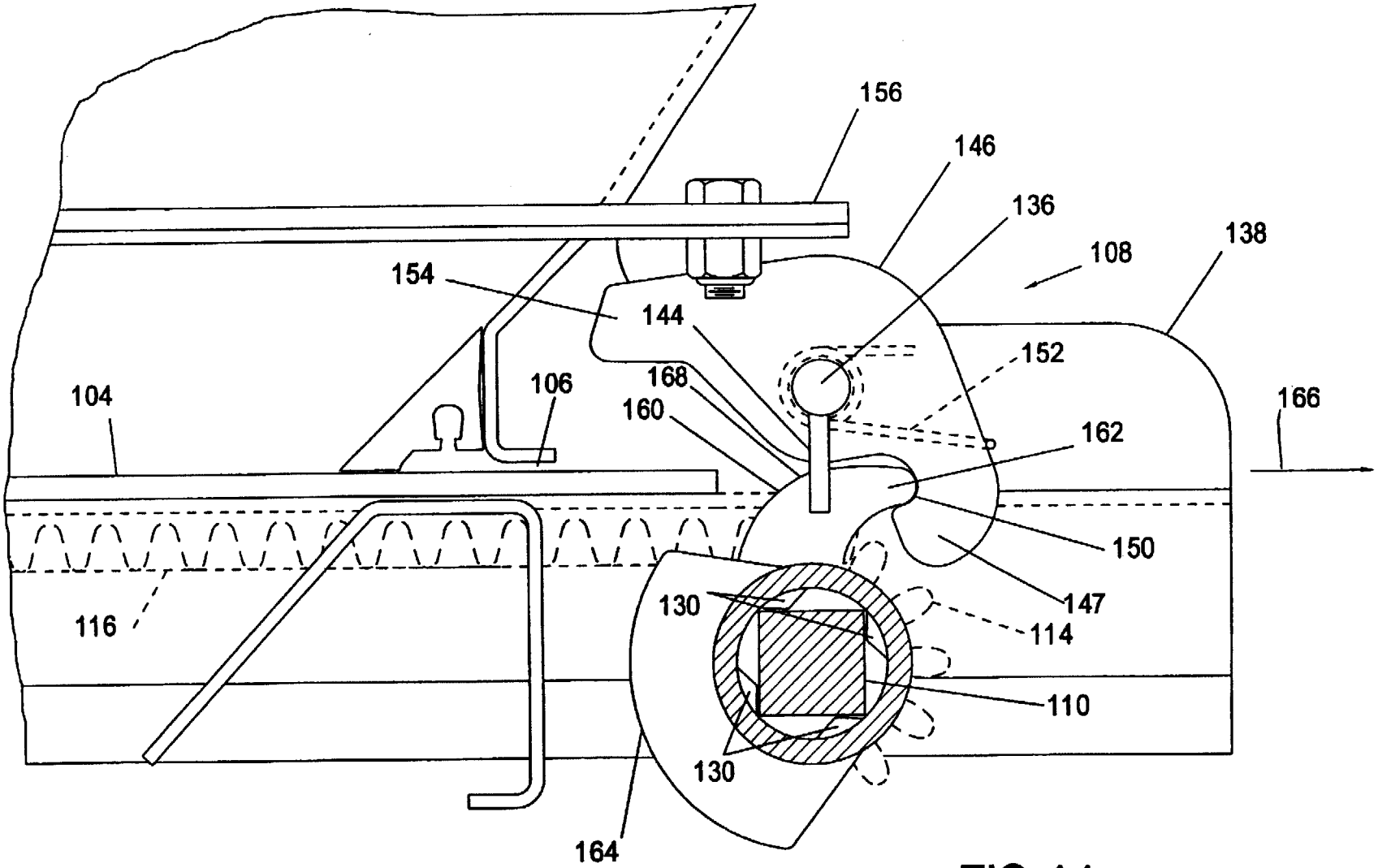
FIGS. 11, 12, and 13 are sectional views, partially broken away, taken generally along line 11—11 of FIG. 8 illustrating the operation of the second embodiment outlet gate assembly.
Figure 12:
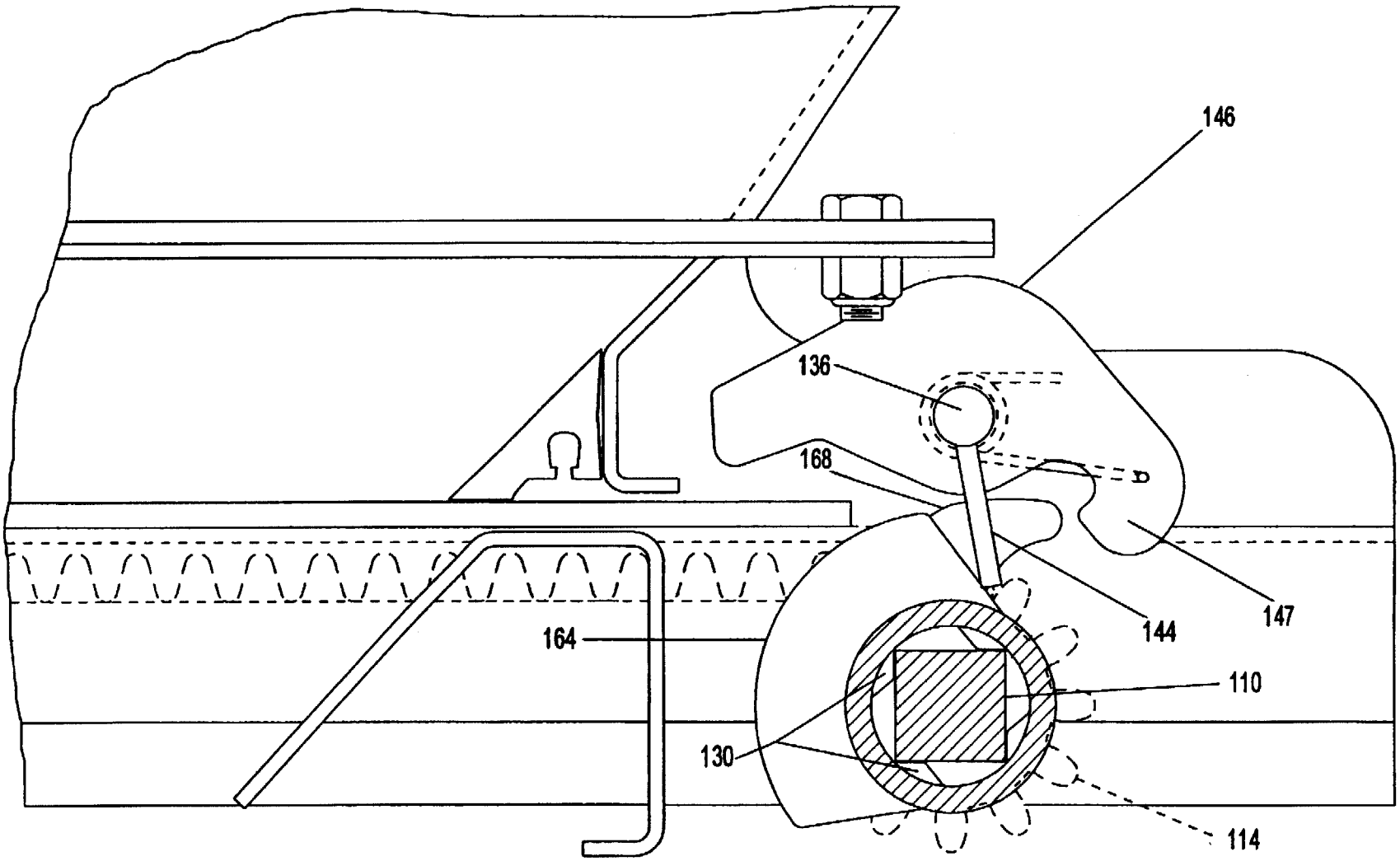
Figure 13:
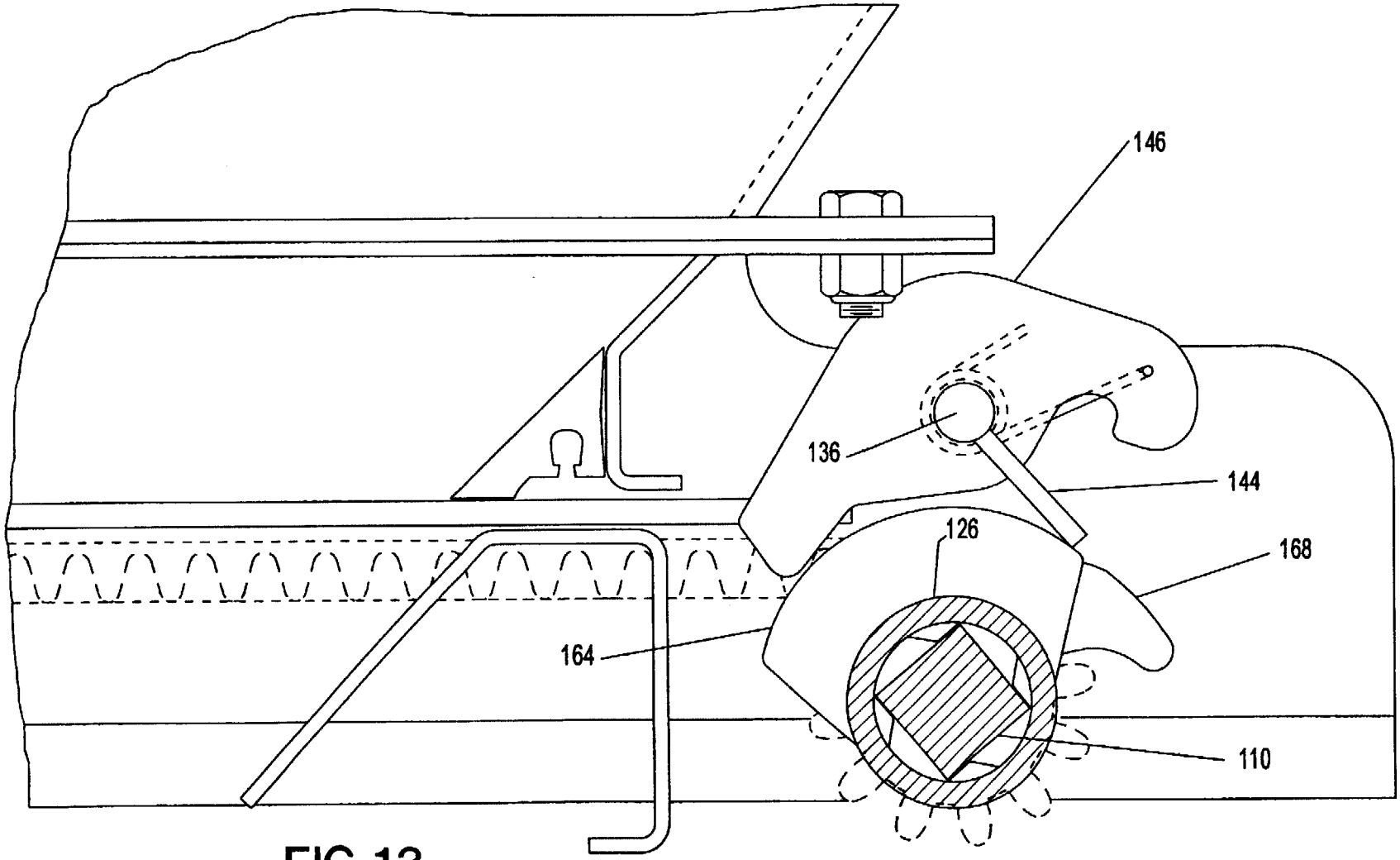

Elongated rotatable latch shaft 136 extends across the rear of frame through holes formed in the extensions 138 and 140 of frame side members and through a support plate 142 mounted on the rear frame member. The ends of the latch shaft extend outwardly of the extensions 138 and 140 above sleeves 126 and 132. Cam follower arms 144 are mounted on the ends of the latch shaft and extend down toward sleeves 126 and 132. A latch 146 is mounted on the end of the latch shaft above collar 124. The latch includes a hook end 147 defining a recess 150 overlying the front side of the sleeve 124. Spring 152 is wound around shaft 136 and includes ends engaging extension 138 and latch 146 to bias the latch, shaft and follower arms in a clockwise direction as shown in FIGS. 10 and 11 so that the hook end of the latch is normally positioned adjacent to sleeve 124. The latch includes a stop end 154 away from hook 147. The end 154 engages flange 156 on the front member of frame 102 to limit clockwise rotation of the shaft, latch and arms. Latch lift finger 158 is mounted on the center of shaft 136 above plate 104.

Latch stop finger 160 is secured to sleeve 124 and rotates with the sleeve and drive shaft 110. Finger 160 includes a tip 162 which fits in recess 150 to latch plate 104 in the closed position through drive shaft 110, pinion gears 114 and racks 116. A latch lift cam 164 having end and dwell surfaces is secured to each rotary sleeve 126 and 132 in position to engage a follower arm 144 upon rotation of the sleeve.

The operation of the second embodiment outlet gate assembly 100 will now be described.

When plate 104 is fully closed, as shown in FIG. 11, latch 146 is lowered with the tip 162 of stop finger 160 seated in recess 150 of latch 146. The engagement between the stop finger and latch prevents collar 124, drive shaft 110 and pinion gears 114 from rotating in an opening direction. Racks 116 engage the latches gears 114 to hold plate 104 latched closed.

The plate 104 is unlatched for opening in direction of arrow 166 shown in FIG. 11 by opening rotation of either capstan 128 or 134. Opening of gate assembly 100 by rotating capstan 128 in the clockwise opening direction first rotates the latch lift cam 164 on sleeve 126 clockwise to engage adjacent cam follower arm 144 and rotate the arm, shaft 136 and latch 146 counterclockwise so that latch hook 147 is rotated out of engagement and above the tip of stationary stop finger 160. Rotation of latch 146 above the stop finger occurs during collapse of the lost motion connection between the sleeve 126 and drive shaft 110 while the drive shaft is stationary.

When the latch has been rotated sufficiently in a clockwise direction to position the hook end 148 out of the path of movement of finger 160, the lost motion connection is fully collapsed, projections 130 on sleeve 126 engage the sides of the drive shaft 110 and the drive shaft is then rotated through a mechanical connection between the sleeve and the drive shaft. Rotation of the drive shaft rotates pinion gears 140 in a clockwise direction to move the plate toward the open position.

When the plate is closed, latch lift finger 158 on shaft 136 extends down in front of the plate 104. Rotation of shaft 136 to lift the latch out of engagement with the stop finger rotates the lift finger upwardly. As the plate is moved to the open position, the leading edge of plate 104 extends under the finger so the finger rests on plate 104 and holds latch 146 above stop finger 160 and arms 144 above the lift cams 164 during opening. Continued opening rotation of the driven capstan 128 moves the plate 104 to the fully opened position with the latch 146 and follower arms 144 held up out of engagement above latch cams 164 and the stop finger 160.

Opening of plate 104 has been described in response to opening rotation of slip socket 128. The plate may also be moved from the closed position to the open position by opening rotation of capstan 134 on slip socket 120. Initial rotation of the slip socket 120 rotates the lift cam 164 on the socket into engagement with adjacent cam follower arm 144 during collapse of the lost motion connection between the slip socket and the drive shaft 110 to rotate latch shaft 136 in a clockwise direction and lift the latch 146 out of engagement with the stop finger 160 prior to collapse of the lost motion connection and initial rotation of the drive shaft 110 to open the gate. Initial opening movement of the plate moves the lead edge of the plate against the lift finger 158 to further rotate the latch shaft so that the latch 146 is lifted above the path of movement of the stop finger 160 and the follower arms 144 are held above the path of the movement of the lift cams 164 during opening of the plate.

Plate 104 is closed from the open position by rotating either of the slip sockets 118 and 120 in a closing direction to collapse the lost motion connection between the driven socket and then move the plate in a closing direction. During closing movement of the plate, finger 158 is held against the upper surface of the plate by spring 152 to hold the latch 146 above rotating stop finger 116 and both follower arms 144 above the rotating latch lift cams 164 on the slip sockets.

As the plate nears the fully closed position, the front edge of the plate is moved under finger 158 so that the finger falls down allowing shaft 136 to rotate back to the position shown in FIG. 11. At the time the finger 158 falls down from the front edge of the plate stop finger 160 is away from hook 147 and the latch lift cams 164 are away from follower arms 144. Final rotation of the drive shaft 110 to move the plate 104 to the fully closed position rotates the drive shaft and latch stop finger 160 in a counterclockwise direction as viewed in FIG. 11 so that cam surface 168 on the latch stop finger 160 is rotated up against and engages hook 147 and rotates the latch 146 counterclockwise sufficiently to permit the stop finger to move past the latch. When the plate 104 is fully closed, latch stop finger 160 is in the position of FIG. 10 and spring 152 has rotated latch 146 down to position hook 148 in engagement with the tip 162 of the stop finger, thereby positively latching the plate closed. During closing of the plate, the latch lift cams 164 do not prevent downward rotation of the cam follower arms 144, although the follower arm 144 adjacent the non-driven socket may be lowered into engagement with one side of the lift cam 164 on the non-driven socket to rotate the socket through a slight angle on the drive shaft so that the cam does not obstruct latching of the plate.

The lost motion connection between the slip sockets and the drive shaft in both disclosed embodiments are located at the ends of the drive shafts and are readily accessible during assembly of the integrated plate drives. This ready accessibility of the lost motion connections facilitates proper timing of the drives, both at the original equipment manufacturer's shops and at the shop of railway car manufacturers. Railway car manufacturers conventionally disassemble railway car gate assemblies in the process of building hopper cars using the gate assemblies. After disassembly, it is necessary to reassemble the gates and properly time the integrated gate drives. The locations of the lost motion connections between the slip sockets and the drive shaft at the sides of the frames facilitates proper timing of the gates, particularly when the assembly is done by workers in manufacturer's yards who are not specifically trained to assemble gates.

The lift cams and follower arms of both embodiments of the disclosed gate assemblies are located on the sides of the assembly and are readily available for inspection by workers to determine whether they are working properly. Further, the wiping action between the lift cams and the arms cleans the contact areas between the cams and arms to facilitate proper actuation of the lost motion drives. Likewise, the latch and stop finger of gate assembly 100 are located on one side of the assembly where they may easily be inspected to assure proper operation.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. An outlet gate assembly for a hopper-type rail car, the assembly including a frame defining a generally rectangular opening and including a pair of parallel and opposed side member extensions; a generally rectangular plate mounted on the frame for movement between opened and closed positions; a drive shaft; bearings mounting the drive shaft on the frame side member extensions, said drive shaft including a pair of ends extending outwardly from the side member extensions; a pair of sleeves mounted on the ends of the shaft outboard of the side member extensions; a pair of capstans on the sleeves; a pair of racks on the plate; a pair of pinion gears on the drive shaft with said pinion gears engaging said racks so that rotation of a capstan moves the gate between opened and closed positions; a rotary lost motion drive element arranged between each capstan and the plate; a plate latch member on the frame located adjacent to the drive shaft and adjacent to one side member extension, a lift member movable by one of said capstans, an operative connection between the lift member and the latch member whereby movement of said one capstan in a direction to open the plate moves the lift member during collapse of the rotary lost motion drive element to unlatch the plate prior to opening movement of the plate.

2. An assembly as in claim 1 wherein each lift member is located on a respective one of said sleeves and the operative connection extends past a respective one of said side member extensions located adjacent to said respective one of said sleeves.

3. An apparatus for controlling operation of a railway hopper car discharge gate assembly including a frame defining a generally rectangular discharge opening with a generally rectangular discharge plate mounted on said frame for movement between open and closed positions along a predetermined path of travel, said apparatus comprising:

a drive shaft having opposed ends, said shaft rotatably supported on a pair of frame extensions, a pair of sleeves on the ends of the drive shaft, a pair of capstans on the sleeves, and a rack and pinion connection joining the drive shaft to the plate whereby said plate slidably moves forwardly and rearwardly between open and closed positions in response to rotation of at least one of said capstans;

a lock assembly carried on said frame between the frame extensions and including a displacable stop member which, when said plate is in its closed position, extends into the predetermined path of travel to positively engage an edge of said plate thereby preventing movement of the plate relative to said frame; and wherein a lock assembly drive is provided between each capstan and said lock assembly stop member for positively displacing said stop member from said path of travel of said plate in response to rotation of said at least one of said capstans prior to movement of the plate toward an open position, said drive extending through both said frame extensions.

4. The apparatus according to claim 3 wherein said stop member is pivotally mounted on said frame for vertical movement about a fixed generally horizontal axis extending generally parallel to said drive shaft.

5. The apparatus as in claim 4 wherein said drive comprises a rotatable shaft.

6. A railway hopper car outlet gate assembly comprising:

a frame defining a generally rectangular opening, said frame including a first side extension and a second side extension;

a generally rectangular plate mounted on the frame for movement between open and closed positions;

a rotatable drive shaft supported by said frame, said drive shaft having a first end and a second end;

a first socket disposed on said first end of the drive shaft, and a second socket disposed on said second end of the drive shaft;

a pair of spaced racks mounted on the plate;

a pair of pinons located on the drive shaft wherein each pinion is adapted to engage one of said racks;

a rotatable latch shaft supported by said frame and spaced from said drive shaft, said latch shaft having a first end and second end;

a plate latch joined to said latch shaft for latching said plate;

a first cam disposed on said first socket outwardly of said first side extension, and a second cam disposed on said second socket outwardly of said second side extension;

a first cam follower disposed on said latch shaft and positioned outwardly of said first side extension, said first cam follower being engageable with said first cam; and a second cam follower disposed on said latch shaft and positioned outwardly of said second side extension, said second cam follower being engageable with said second cam.

7. The railway discharge hopper car outlet gate assembly of claim 6 wherein each socket comprises a capstan having two ends, and a sleeve extending from one end of each capstan.

* * * * *